US005472189A

United States Patent [19]

Pfeiffer et al.

[11] Patent Number: 5,472,189

[45] Date of Patent: Dec. 5, 1995

[54] TABLE TENNIS BALL DISPENSER

[76] Inventors: Brandon Pfeiffer, 7701 Weilbrenner Rd., Mt. Vernon, Ind. 47620; Brian L. Gross, 801 Cardinal Dr., Evansville, Ind. 47711

[21] Appl. No.: 129,978

[22] Filed: Sep. 30, 1993

Related U.S. Application Data

[63] Continuation of Ser. No. 868,173, Apr. 14, 1992, abandoned.

[51] Int. Cl.[6] ..... A63B 39/00

[52] U.S. Cl. ..... 273/30

[58] Field of Search ..... 273/30; 473/25, 473/33; 224/919, 918, 252, 30; 221/203, 279; 248/311

[56] References Cited

U.S. PATENT DOCUMENTS

| | | | |
|---|---|---|---|
| 1,625,920 | 4/1927 | Thurman | 224/252 |
| 2,545,064 | 3/1951 | Alch . | |
| 2,569,007 | 9/1951 | Klyce . | |
| 3,497,118 | 2/1970 | Najjar . | |
| 3,777,933 | 12/1973 | Joliot . | |
| 3,853,316 | 12/1974 | Smith . | |
| 4,042,156 | 8/1977 | Knight . | |
| 4,046,284 | 9/1977 | Samuelsson | 273/29 R |
| 4,082,209 | 4/1978 | Sanders | 224/919 |
| 4,088,251 | 5/1978 | Rodriguez . | |
| 4,151,936 | 5/1979 | Hawkes . | |
| 4,269,338 | 5/1981 | Sichel . | |
| 4,299,345 | 11/1981 | Lanzl | 224/919 |
| 4,356,915 | 11/1982 | Phillips . | |
| 4,467,946 | 8/1984 | Brown | 224/252 |
| 4,678,108 | 7/1987 | Inman | 274/919 |
| 4,784,305 | 11/1988 | Schoenberg | 224/918 |
| 4,840,332 | 6/1989 | Hoyt | 224/919 |
| 4,850,483 | 7/1989 | Stack . | |

FOREIGN PATENT DOCUMENTS

| | | |
|---|---|---|
| 140388 | 3/1951 | Australia . |

*Primary Examiner*—Theatrice Brown

*Attorney, Agent, or Firm*—Woodard, Emhardt, Naughton, Moriarty & McNett

[57] ABSTRACT

A table tennis ball dispenser in the shape of an elongated tubular body providing openings for selectively receiving and withdrawing table tennis balls. In one preferred embodiment, an opening along the side of the body permits visually indicating the number of table tennis balls in the dispenser. In another preferred embodiment, the dispenser forms a part of one of the legs of a table tennis table and, thereby, further assures ready table tennis ball access. In another preferred embodiment, a gap along the entire body permits complete visual access to the contents of the dispenser and further provides a means for modulating the size of the exit port. A concave back portion is also provided for restrainably securing the dispenser to a variety of surfaces, with or without the aid of surface adapters.

8 Claims, 4 Drawing Sheets

TABLE TENNIS BALL DISPENSER

REFERENCE TO RELATED APPLICATIONS

This application is a continuation-in-part of U.S. patent application Ser. No. 07/868,173 filed on Apr. 14, 1992, (abandoned) by the same inventive entity, and entitled TABLE TENNIS BALL DISPENSER.

BACKGROUND OF THE INVENTION

This invention relates generally to a mountable apparatus for storing and displaying a plurality of game balls and more specifically to such an apparatus for the game of table tennis wherein the apparatus is mountable to a suitable location and preferably to the leg of a table tennis table.

As is known, it is desirable in any ball-related sport to have a convenient storage apparatus for storing a supply of game balls. It is even more desirable to have an apparatus for keeping a supply of game balls close at hand during the playing of a particular game. Such apparatuses are known to exist for a variety of games.

In the game of table tennis, for example, U.S. Pat. No. 3,853,316 discloses a tubular shaped table tennis ball holder attachable to the underside of a table tennis table wherein table tennis balls are released from their stored position by squeezing the holder.

the game of marbles, U.S. Pat. No. 4,151,936 discloses a belt comprising a pair of coextensive flexible housings spaced at a smaller distance than the diameter of a marble. Insertion of marbles between the housings cause the housings to separate and thereby hold the marbles between them. U.S. Pat. No. 4,356,915 discloses a hollow torus-shaped container for housing a plurality of marbles and an aperture in the housing for inserting and withdrawing marbles.

In the game of tennis, U.S. Pat. No. 4,046,284 discloses a mountable hollow tube-shaped container for strong tennis balls including a stop spaced below the open end of the container to prevent balls from dropping out. U.S. Pat. No. 4,088,251 discloses a tennis ball carrying device mountable upon the back of a tennis player. The carrying device is tube-shaped with an elliptical-shaped dispenser end extending at a right angle from the device. U.S. Pat. No. 4,269,338 discloses a mountable tennis ball holder for retaining up to two tennis balls wherein a tennis ball is released from the holder by flexing an elastic ball retaining member. U.S. Pat. No. 4,042,156 discloses a tennis ball carrier, mountable upon a tennis player, comprising two axially aligned compartments with a retaining lip at each of the opposed ends.

In the game of golf, U.S. Pat. No. 3,497,118 discloses a belt mountable ball holder comprising a lower stop platform and temporarily deformable sleeve fingers for retaining golf balls. U.S. Pat. No. 3,777,933 discloses a mountable golf ball holder comprising a support frame and a moveable sleeve member for releasing the golf balls. U.S. Pat. No. 4,082,209 discloses a mountable golf ball holder comprising a hollow cylinder for housing a plurality of golf balls and a resilient retaining finger at the withdrawal port for preventing golf balls from dropping out. U.S. Pat. No. 4,678,108 discloses a rigid golf ball carrier tube for carrying a plurality of golf balls and having a restricted exit port whereby withdrawal of a golf ball is achieved by deforming a flexible retaining ring located at the exit port. U.S. Pat. No. 4,850,483 discloses a flexible and mountable golf ball holder for holding a plurality of golf balls wherein golf balls must be forced into the holder and removal is achieved by working the golf ball through a flexible discharge aperture.

Finally, U.S. Pat. No. 140,388 discloses a game apparatus comprising a plurality of ball retaining tubes capable of ejecting balls when struck at their base by another ball.

Regarding the game of table tennis, it is further desirable to have a table tennis ball storing and dispensing apparatus within close proximity of a table tennis table. Preferably, such an apparatus would either be mountable to, or an integral part of, the table.

Apparatuses incorporated within table tennis tables for storing table tennis balls are known to exist. For example, U.S. Pat. No 2,545,064 discloses a collapsible table tennis table incorporating a rectangular storage rack on the underside of the table for housing table tennis paddles and table tennis balls Similarly, U.S. Pat. No 2,569,007 discloses a table tennis table incorporating a storage chamber within the table top for housing a plurality of table tennis balls and including an exit aperture for ball retrieval.

The known apparatuses for storing and dispensing game balls suffer from a variety of shortcomings. Most contain complex structures and are therefore difficult and expensive to manufacture. Some lack convenient means for restrainably mounting the apparatus proximate to the playing area. Others are difficult to operate and therefore hinder the storage and/or retrieval of game balls. It would therefore be extremely desirable, particularly for the game of table tennis, to have an inexpensive and easy to operate game ball dispenser that can readily be secured to a surface proximate to the playing area, such as a table tennis table leg.

SUMMARY OF THE INVENTION

It is the principal object of this invention to provide a durable and inexpensive table tennis ball dispenser to be either integral to, or attachable to, a leg of a table tennis table.

It is another object of this invention to provide a table tennis ball dispenser adaptable to be affixed to a variety of surfaces.

These and other objects of the present invention will become more apparent from the following description of the preferred embodiment.

DESCRIPTION OF THE PREFERRED EMBODIMENT

Figure 1:
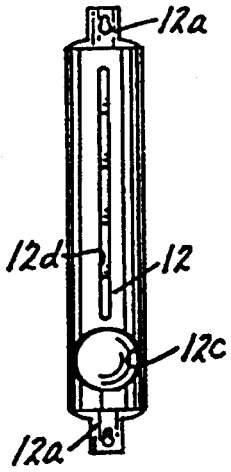
FIG. 1 is a frontal view of one preferred embodiment of a table tennis ball dispenser according to the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
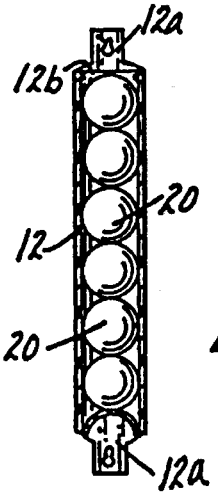
FIG. 2 is a frontal view of the table tennis ball dispenser of FIG. 1 in cross-section.

Referring now to FIGS. 1 and 2, one preferred embodiment of the table tennis ball dispenser of the present invention is characterized by an elongated longitudinal hollow member 12 having securement tabs 12*a* extending from opposite ends thereof. Member 12 has an open upper end 12*b* into which a table tennis ball 20 is introduced and a lower side opening 12*c* through which a table tennis ball 20 is withdrawn. In another preferred embodiment of the invention, the side wall of the elongated member 12 includes a slot 12*d* for visually indicating the number of table tennis balls 20 in storage within the member 12.

Figure 3:
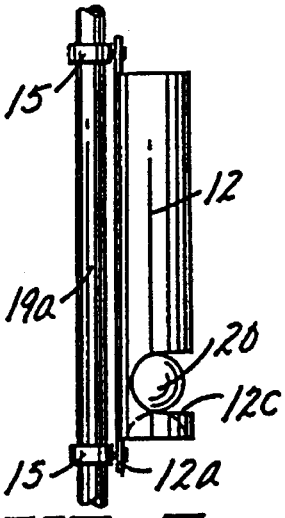
FIG. 3 is a side view of the table tennis ball dispenser of FIG. 1 showing connection of the dispenser to a curved surface.
Figure 4:
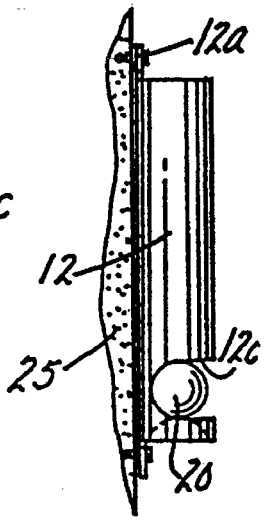
FIG. 4 is a side view of the table tennis ball dispenser of FIG. 1 showing connection of the dispenser to a flat surface.

FIGS. 3 and 4 illustrate a lower table tennis ball withdrawal opening 12*c* in the form of a cut-out and to structures maintaining the dispenser 12 at a useful location.

Figure 5:
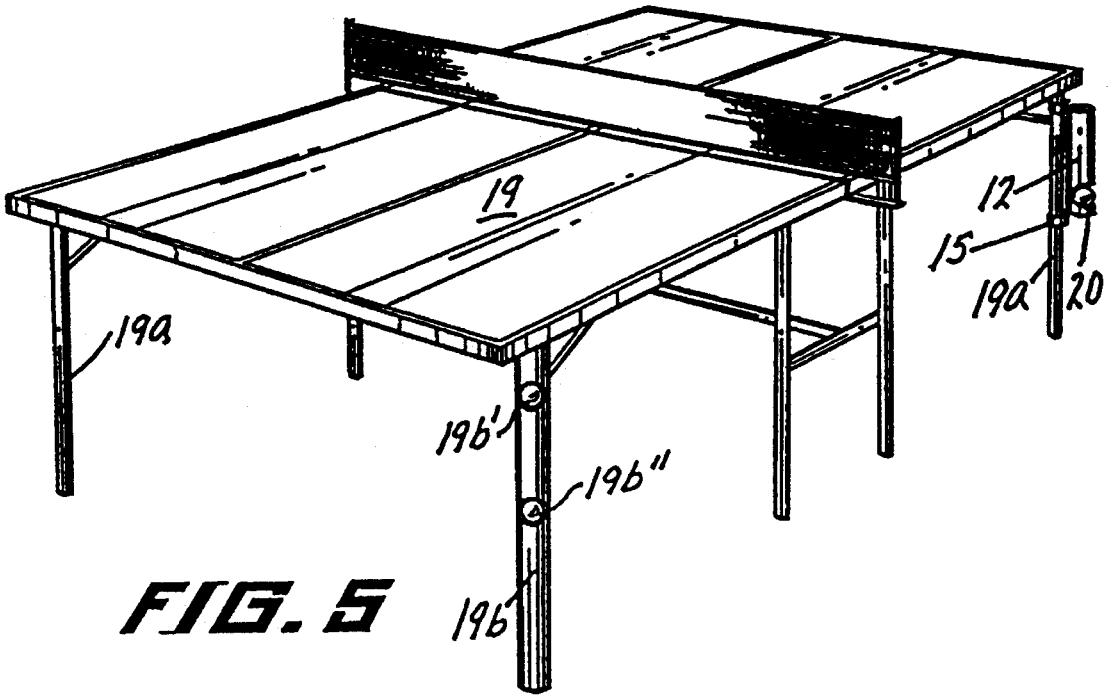
FIG. 5 is a perspective view of a table tennis table showing a dispenser, as that of FIG. 3, attached thereto and, additionally, a table leg formed into the table tennis ball dispenser per se.

FIG. 3 illustrates the provision of clamps 15 for securing the tabs 12*a* of the member 12 onto, for example, a leg 19*a* of a table tennis table 19 (also see FIG. 5). FIG. 4 illustrates a securing arrangement where the dispenser is mounted on a solid surface, as, for example, a concrete block wall 25 which is located in the region of the table tennis table 19.

FIG. 5 illustrates a version of the invention wherein a leg 19*b* of the table tennis table 19 is enlarged to serve as the dispenser. In this instance, the side wall of the leg includes the table tennis ball entry 19*b'* and, there below, a cut-out 19*b"* for table tennis ball withdrawal. In this arrangement, either of legs 19*a* or 19*b* may be in the form of a dispenser or be affixed to a dispenser on each side of the table tennis table 19. FIG. 5 shows one preferred embodiment of this arrangement wherein table tennis table leg 19*b* comprises a table tennis ball dispenser and leg 19*a* on the opposite side of table tennis table 19 comprises another table tennis ball dispenser.

Figure 6:
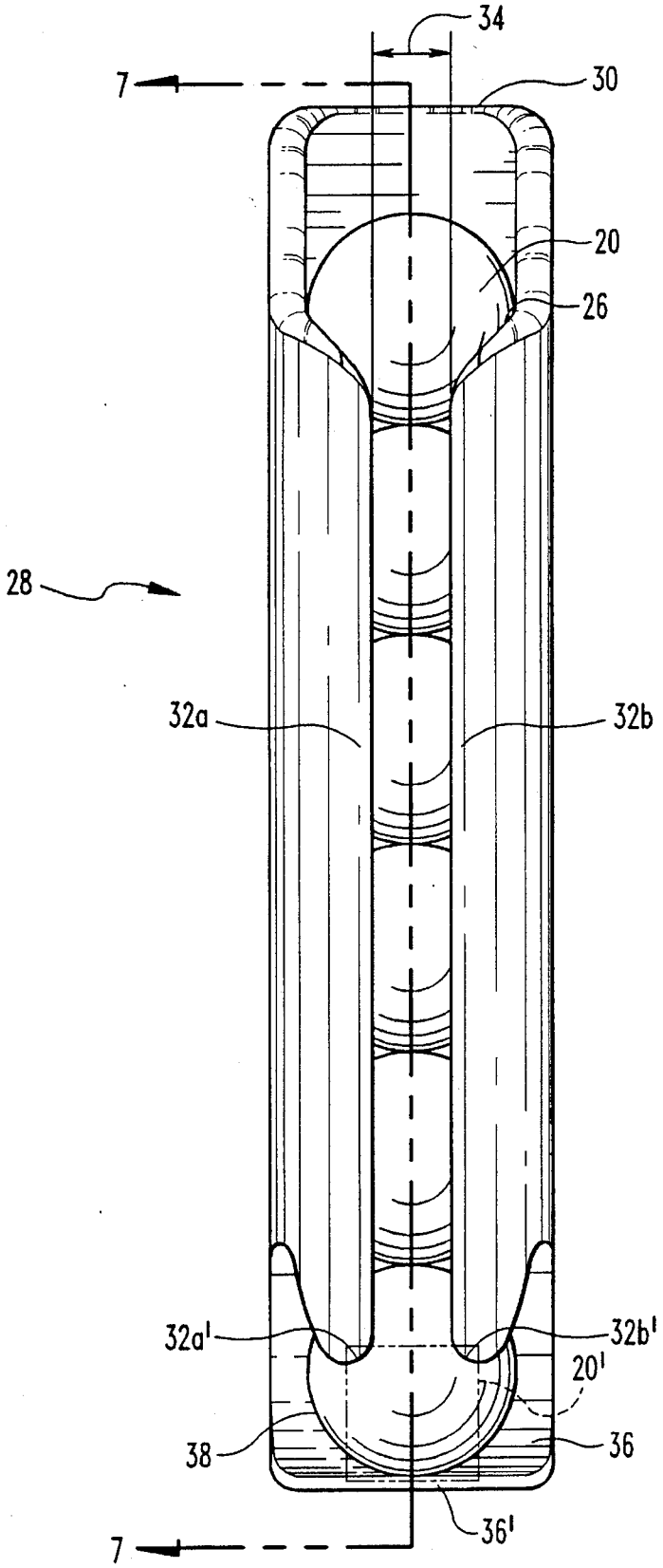
FIG. 6 is a frontal view of another preferred embodiment of a table tennis ball dispenser according to the present invention.

Referring now to FIG. 6, an improved embodiment of a table tennis ball dispenser according to the present invention is shown. In this embodiment, flanges 32*a* and 32*b* extend from either side of elongated body 30 and curve toward each other to form a gap 34 extending the length of table tennis ball dispenser 28. Gap 34 provides an easy means for allowing a table tennis player to obtain a visual indication of the number of table tennis bails 20 housed within dispenser 28. Additionally, gap 34 works in concert with restraining tab 36 to operate as exit port 38. Although table tennis ball dispenser 28 may be constructed from individual components, elongated body 30, restraining tab 36 and flanges 32*a* and 32*b* form one integral unit in the preferred embodiment. The material used to make table tennis dispenser 28 must be rigid enough to hold its shape but be flexible enough to withstand use and transport without being damaged. The present preferred material is plastic which is capable of being easily molded using known technology, is light weight and durable, and is inexpensive to manufacture.

Figure 7:
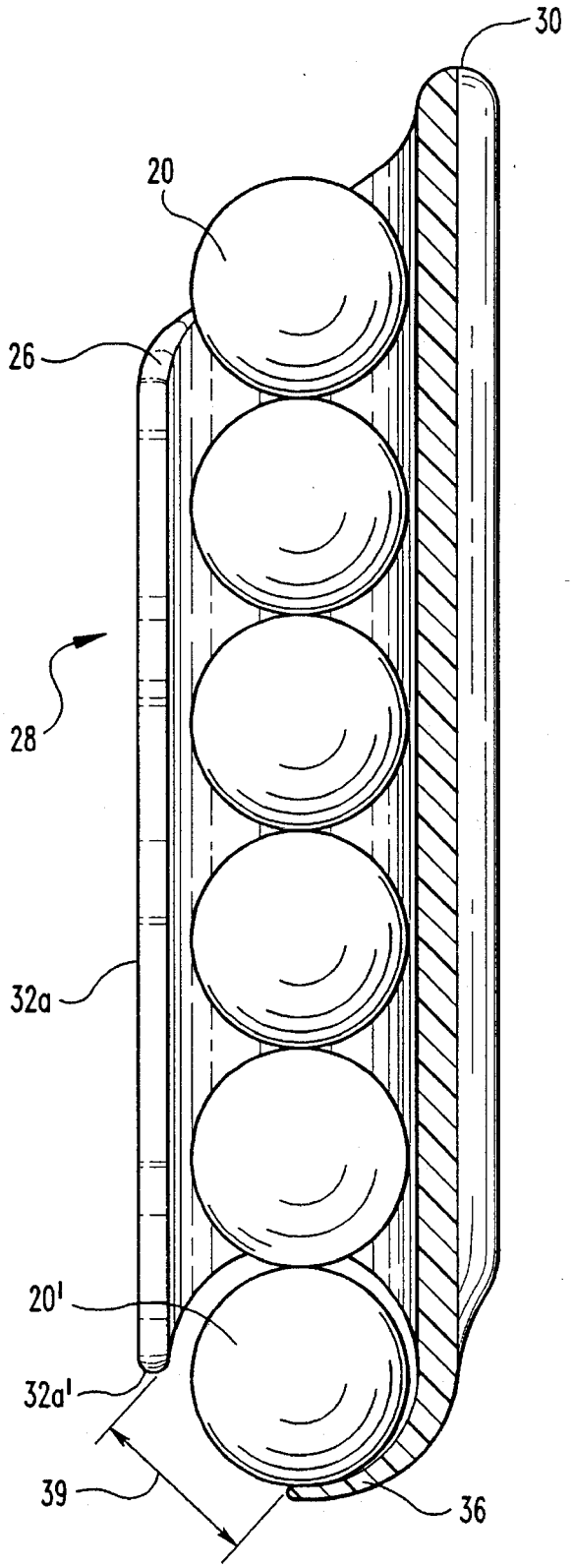
FIG. 7 is a side and cross-sectional view of the table tennis ball dispenser of FIG. 6.

Referring to both FIGS. 6 and 7, a plurality of table tennis balls 20 is shown as being vertically stacked and loosely held within table tennis ball dispenser 28. Restraining tab 36 is shown as extending from the lower end of body portion 30 and curving towards flanges 32*a* and 32*b*. Exit port 38 is defined by the lower ends 32*a'* and 32*b'* of flanges 32*a* and 32*b* respectively and the edge 36' of restraining tab 36 as shown in FIGS. 6 and 7. Thus, regardless of the number of table tennis balls 20 housed within table tennis ball dispenser 28, the first table tennis ball 20' deposited into dispenser 28 at entrance 26 will be forced by gravity to exit port 38. Exit port 38 is sized be smaller than the diameter of a table tennis ball 20 so that a stack of table tennis balls can be restrainably held within dispenser 28 as shown. Table tennis ball 20' is withdrawn from dispenser 28 by forcing it against flange ends 32*a'* and 32*b'* and restraining tab edge 36'. This action causes flange ends 32*a'* and 32*b'* to flex in the direction of force thereby temporarily widening gap 34 in a region proximate to flange ends 32*a'* and 2*b'*. This forcing action also causes flange edge 36' to flex in a direction opposite to the direction of force, thereby temporarily widening gap 39, formed between flange edges 32*a'* and 32*b'* and restraining tab edge 36' as shown in FIG.7. Thus, when sufficient force is applied to table tennis ball 20' the cumulative flexing of flange ends 32*a'* and 32*b'* and restraining tab edge 36' cause exit port 38 to become large enough to allow passage of table tennis ball 20' therethrough. Upon withdrawal of of ball 20', flange edges 32*a'* and 32*b'* and restraining tab edge 36' return to their pre-force positions and gravity forces any balls remaining within dispenser 28 toward exit port 38.

Figure 8:
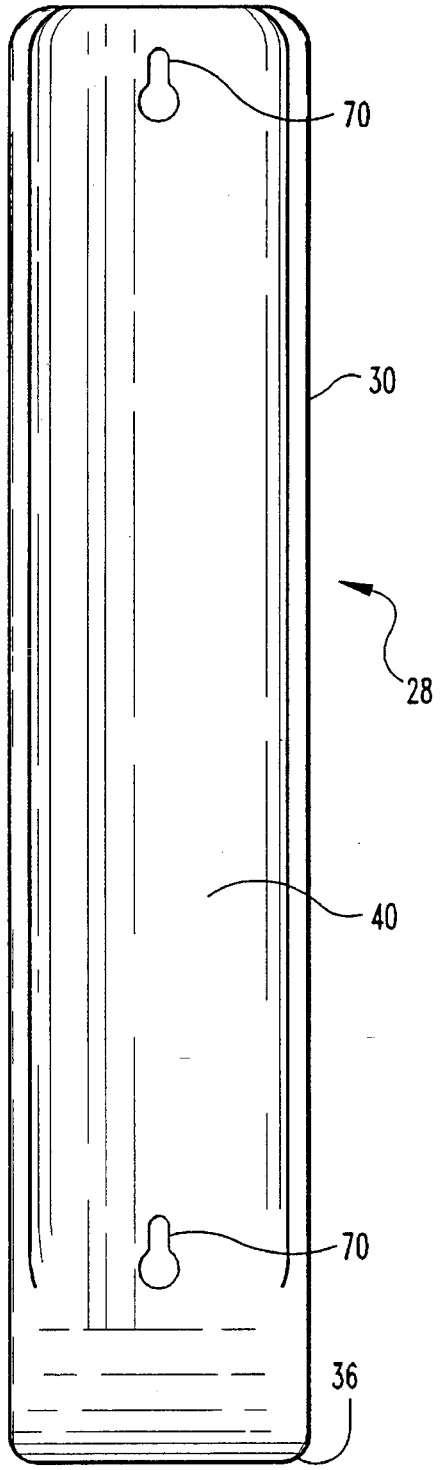
FIG. 8 is a view of the back of the table tennis ball dispenser of FIG. 6.

Referring now to FIG. 8, the back surface 40 of elongated body 30 is shown as being concave with a predetermined radius of concavity. Tills design facilitates the securing of dispenser 28 to a curved surface.

Figure 9:
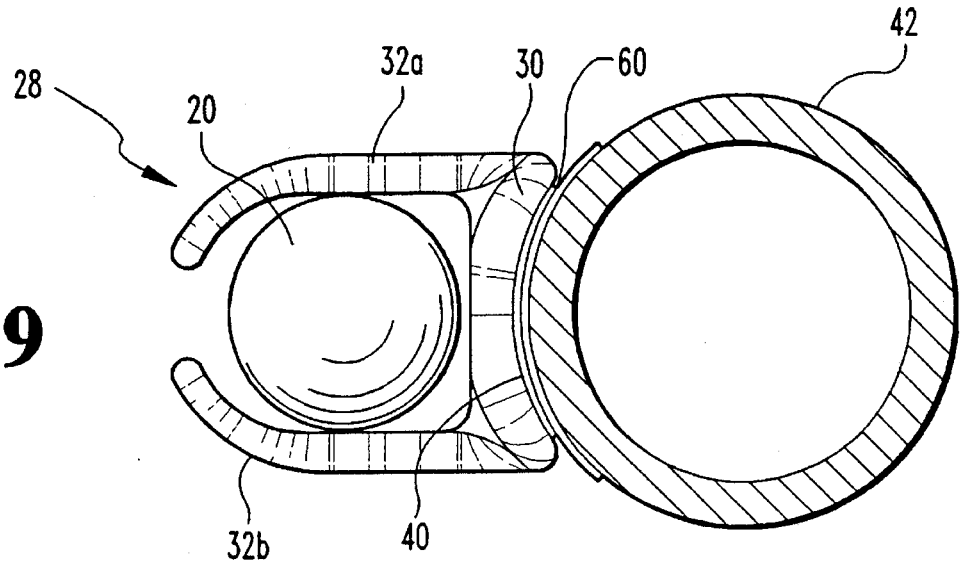
FIG. 9 is a top view showing attachment of the table tennis ball dispenser of FIG. 6 to a pole having a firs radius.

Referring now to FIG. 9, back surface 40 of table tennis ball dispenser 28 is shown as being affixed to a curved surface having a known radius of curvature. In one preferred embodiment, the curved surface is a tube-shaped leg 42 of a table tennis table having an outer surface radius approximately equal to the radius of concavity of back surface 40. Back surface 40 is affixed to leg 42 by known affixing techniques, thereby restrainably securing table tennis ball dispenser 28 to leg 42.

Figure 10:
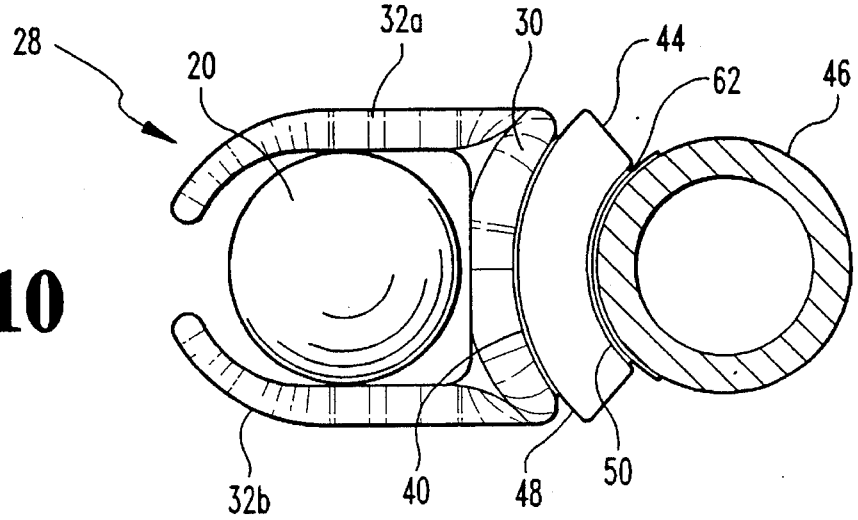
FIG. 10 is a top view showing attachment of the table tennis ball dispenser of FIG. 6 to an adapter and then to another pole having a second radius.

Referring now to FIG. 10, back surface 40 of table tennis ball dispenser 28 is shown as being affixed to convex surface 48 of adapter 44. The radius of convexity of surface 48 is approximately equal to the radius of concavity of back surface 40. Back surface 40 is affixed to convex surface 48 of adapter 44 using known affixing techniques. Adapter 44 also has a surface 50 with a predetermined radius of concavity different than the radius of concavity of back surface 40, for affixing surface 50 to another curved surface having a known radius of curvature different than the radius of concavity of back surface 40. In one preferred embodiment, this curved surface is a tube-shaped leg 46 of a table tennis table having an outer surface radius approximately equal to the radius of concavity of adapter surface 50, but smaller than the outer radius of leg 42. Adapter surface 50 is affixed to leg 46 using known affixing techniques, thereby restrainably securing table tennis ball dispenser 28 to leg 46.

Figure 11:
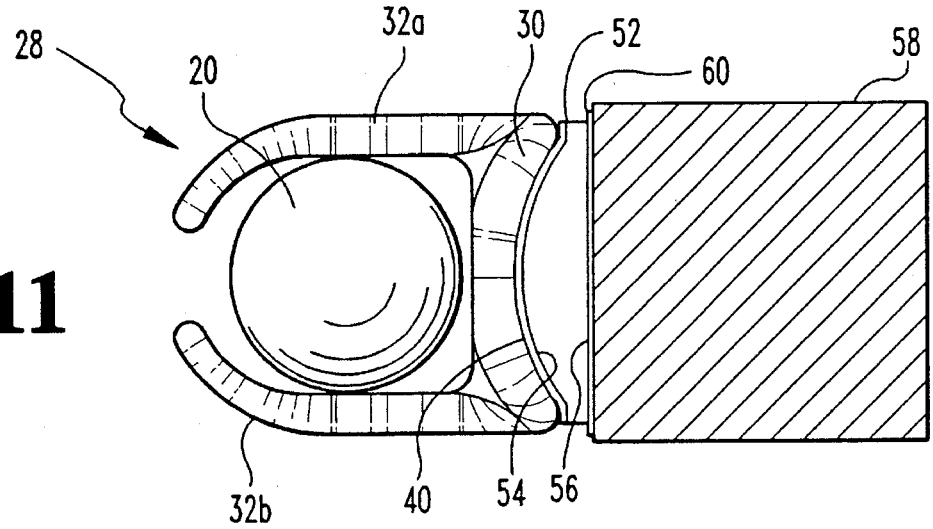
FIG. 11 is a top view showing attachment of the table tennis ball dispenser of FIG. 6 to another adapter and then to a flat surface.

Referring now to FIG. 11, back surface 40 of table tennis ball dispenser 28 is shown as being affixed to convex surface 54 of adapter 52. The radius of convexity of surface 54 is approximately equal to the radius of concavity of back surface 40. Back surface 40 is affixed to convex surface 54 of adapter 52 using known affixing techniques. Adapter 52 also has a flat surface 56 for affixing adapter 52 to a flat surface. In one preferred embodiment, the flat surface is a square-shaped leg 58 of a table tennis table. Adapter surface 56 is affixed to leg 58 using known affixing techniques, thereby restrainably securing table tennis ball dispenser 28 to leg 58.

Although a variety of known techniques may be used for affixing table tennis ball dispenser 28 to leg 42 or for affixing either of adapters 44 and 52 to legs 46 and 58 respectively, one preferred embodiment uses Velcro® tape 60 on each of the convex and concave surfaces. Similarly, a variety of known techniques may be used for affixing table tennis ball dispenser 28 to either adapter 44 or adapter 52, and one preferred embodiment uses two-sided adhesive tape 62 between the convex and concave surfaces while another embodiment uses plastic glue Finally, dispenser 28 may be affixed to any flat surface without using adapter 52 by hanging dispenser 28 on nails, screws, pegs, or the like, through wall mount holes 70 located on back surface 40 as shown in FIG. 8.

As should be evident, therefore, the invention serves desirable convenience for a table tennis player, i.e. makes the table tennis balls readily available for use importance lies in the fact that the dispenser is readily located in the region of a standard table tennis table and, further, that either the legs of the table can be modified to permit the desired dispensing or the dispenser itself can be modified to fit the legs of a particular table tennis table. As to fabrication, the dispenser can be made from extruded plastic resin, thus being light in weight and yet achieving strength against accidents and/or in transporting.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A dispenser for table tennis balls, said dispenser comprising:

an elongated body portion having a first surface, a lower end and two opposing sides;

elongated flange portions each having lower flange ends and flange edges, one of said flange portions projecting from each of said opposing sides of said body portion and curving generally toward each other to a first predetermined distance between said flange edges; and a restraining tab projecting from said lower end of said body portion and extending generally toward said lower flange ends;

wherein said first surface of said elongated body and said flange portions define a cavity for loosely receiving a plurality of spheres therein, and wherein said lower flange ends and said restraining tab are resiliently flexible and form a restricting exit port for normally retaining said plurality of spheres within said dispenser, and wherein gravity forces said plurality of spheres downwardly into a withdrawing position at said exit port;

and further wherein a sphere may be withdrawn from said exit port by forcing said sphere against said exit port sufficiently to flex said restraining tab and said lower flange ends until a sphere may exit through said exit port.

2. The dispenser of claim 1, wherein said restraining tab defines a tab edge extending generally toward said lower flange ends to a second predetermined distance between said tab edge and said lower flange ends; wherein said exit port is sized slightly less than said sphere.

3. The dispenser of claim 2, further comprising a plurality of spheres vertically stacked within said cavity.

4. The dispenser of claim 3, wherein said spheres comprise table tennis balls.

5. The dispenser of claim 4, said body further comprising a second surface facing opposite of said first surface, said second surface being concave for receiving a round table tennis table leg.

6. The dispenser of claim 5, said second surface further comprising a plurality of port means for receiving a corresponding plurality of hanging means.

7. The dispenser of claim 6, wherein said dispenser is made from plastic.

8. The dispenser of claim 7, wherein said dispenser is of unitary construction.

* * * * *

UNITED STATES PATENT AND TRADEMARK OFFICE

CERTIFICATE OF CORRECTION

PATENT NO. : 5,472,189

DATED : December 5, 1995

INVENTOR(S) : Brandon Pfeiffer and Brian L. Gross

It is certified that error appears in the above-indentified patent and that said Letters Patent is hereby corrected as shown below:

In Column 1, line 29 "the" should read -- In the--.

In Column 3, line 4 "firs" should read --first--.

In Column 3, line 66 "bails" should read --balls--.

In Column 4, line 44 "Tills" should read --This--.

In Column 5, line 34 "use importance" should read --use. Importance--.

Signed and Sealed this

Twenty-third Day of July, 1996

*Attest:*

Bruce Lehman

BRUCE LEHMAN

*Attesting Officer*

*Commissioner of Patents and Trademarks*